US005503404A

United States Patent [19]

Newton et al.

[11] Patent Number: 5,503,404

[45] Date of Patent: Apr. 2, 1996

[54] PROTECTOR FOR DRIVE SHAFT LIP SEAL

[76] Inventors: John R. Newton, 207 Elsa Rd., Jupiter, Fla. 33477; Jeffrey W. Strong, 485 Royal Palm Way, Boca Raton, Fla. 33432

[21] Appl. No.: 316,882

[22] Filed: Oct. 3, 1994

Related U.S. Application Data

[63] Continuation-in-part of Ser. No. 137,495, Oct. 14, 1993, Pat. No. 5,370,400.

[51] Int. Cl.[6] ..... F16J 9/00; B23P 11/02

[52] U.S. Cl. ..... 277/9.5; 277/11; 29/235

[58] Field of Search ..... 277/9, 9.5, 10, 277/11, 152; 29/235

[56] References Cited

U.S. PATENT DOCUMENTS

| | | | |
|---|---|---|---|
| 3,975,026 | 8/1976 | Boyle et al. | 277/134 |
| 4,218,813 | 8/1980 | Cather, Jr. | 277/10 |
| 4,515,376 | 5/1985 | Okamuro | 277/9.5 |
| 4,658,670 | 4/1987 | Yasui et al. | 277/11 |
| 4,815,884 | 3/1989 | Halliday, Jr. et al. | 277/10 |
| 5,052,695 | 10/1991 | Curtis | 277/9 |

*Primary Examiner*—Daniel G. DePumpo
*Attorney, Agent, or Firm*—Michael Ebert

[57] ABSTRACT

A sealing system for a drive shaft extending through the hull of a vessel, the outboard end of the shaft being coupled to a propeller and the inboard end to the transmission of a marine engine turning the propeller. The system includes a bearing surrounding the shaft and an elastomeric lip seal coaxial with the shaft mounted adjacent one end of the bearing to prevent water from leaking into the vessel. The system is installed by passing the inboard end of the shaft through the bearing and the seal. Prior to such installation a protector sleeve is telescoped into the lip seal to shield its inner surface and thereby prevent damage thereto by sharp edges on the inboard end of the shaft, the sleeve having a brim which then rests against the end of the bearing. Upon completion of the installation, the sleeve is pulled by its brim out of the seal and is then ripped off the shaft.

7 Claims, 2 Drawing Sheets

PROTECTOR FOR DRIVE SHAFT LIP SEAL

RELATED APPLICATION

This is a continuation-in-part application of our prior application Ser. No. 08/137,495 now U.S. Pat. No. 5,370,400 filed Oct. 14, 1993 on a "FLUID ENVIRONMENT SEALING SYSTEM" the entire disclosure of which is incorporated herein by reference.

BACKGROUND OF INVENTION

1. Field of Invention

This invention relates generally to a sealing system for the drive shaft of a marine propeller, the system including a bearing and a lip seal coaxial with the shaft mounted adjacent one end of the bearing, and more particularly, to a system of this type which prior to being installed on the shaft is provided with a protector having a sleeve that is telescoped into the lip seal and acts as liner therefor to prevent the seal from being damaged when in the course of installation, the inboard end of the shaft is inserted through the lip seal.

1. Status of Prior Art

Our above-identified copending application discloses a sealing system for the drive shaft of a marine propeller, the shaft extending through the hull of a boat and being coupled at its outboard end to the propeller. The inboard end of the shaft is coupled to the transmission of a marine engine for turning the propeller. The sealing system disclosed in our copending patent application includes a cylindrical bearing surrounding the rotary drive shaft and an elastomeric lip seal coaxial with the shaft mounted within the bearing adjacent one end thereof to prevent water from leaking through the bearing into the boat.

Formed within the cylindrical body of the bearing is an annular reservoir within which the seal is positioned. Sea water conducted along the shaft within the bearing is fed into the reservoir and discharged therefrom back to the sea. This circulating flow of water acts to lubricate and cool the lip seal and thereby maintain it in working order. In the absense of such lubrication, the heat generated by the friction between the shaft and the seal would in time render the seal ineffective.

When installing a sealing system of this type, the inboard end of the drive shaft must be made to pass through the bearing and the lip seal mounted therein. We have found that in many instances the lip seal will be damaged by this installation procedure, for the inboard end of the shaft is not perfectly smooth and free of sharp edges, and in passing through the elastomeric lip seal it may abrade, score and otherwise mutilate the lip seal. As a consequence the installed sealing system may leak and not be effective for its intended purpose.

The reason there are sharp edges on the inboard end of the typical drive shaft is that it has a key way indented therein to lock the shaft to a coupling for the transmission of the marine engine. And there are also indentations to receive set screws to lock the coupling to the shaft. Moreover, the blunt end of the shaft has a fairly sharp circular edge. These sharp metal edges on the inboard end of the shaft cut into the lip of the elastomeric lip seal when the shaft is pushed therethrough, and may mutilate the seal and render it ineffective.

But this is not the only problem encountered in the course of installing, for the blunt end of the drive shaft, when seeking to pass through the lip seal, may catch it and distort its shape, causing the 360 degree retainer spring located in the shoulder of the lip seal and holding it in place in the bearing to pop out. Should the retainer spring be bumped from its seat, the life of the seal will be substantially shortened. The installation of a sealing system is a blind procedure, for the installer cannot see into the bearing. The installer therefore will not know whether the retainer spring for the lip seal has been dislodged from its seat.

Similar problems are encountered when retrofitting a sealing system several times in the course of a vessel's life. Each time the sealing system is installed on the drive shaft, the shaft will then bear scar marks left by wrenches, hammers, coupling pullers and other tools employed in making the installation. These marks and scars contribute to the damage inflicted by sharp edges when the shaft is forced through the elastomeric lip seal. Further damage to the lip seal results from rust and pitting formed on the surface of the drive shaft in the course of prolonged operation in the environment of the vessel.

SUMMARY OF INVENTION

In view of the foregoing, the main object of this invention is to provide in combination with a sealing system installable on the drive shaft of a marine propeller that includes a bearing surrounding the shaft and an elastomeric lip seal coaxial with the shaft to prevent water leakage from the bearing, a protector for the lip seal which when the system is being installed acts as an inner liner for the seal to prevent damage thereto as to the inboard end of the drive shaft is being projected therethrough.

More particularly, an object of this invention is to provide a frangible protector of the above type formed by a plastic sleeve that telescopes into the lip seal and has a brim that then rests against the end of the bearing, whereby after the installation is completed the protector may be pulled out of the lip seal by its brim and then torn off the shaft.

A significant feature of the invention is that the sleeve of the protector, when telescoped in the lip seal, then shields the inner surface of the seal from rough or sharp edges and other discontinuities on the surface of the shaft which had the seal been unshielded, would act to cut and mutilate the lip seal as the inboard end of the shaft passes therethrough in the course of installing the sealing system.

Also an object of the invention is to provide a frangible protector for a lip seal which is easily withdrawn therefrom after having served its purpose to a position on the shaft outside the lip seal, the protector being then tearable so that it can be readily detached from the shaft.

While a lip seal protector in accordance with the invention will be described in connection with a sealing system for a marine propeller drive shaft of the type disclosed in our copending application, it is to be understood that the protector is also useable with any other type of sealing system having a lip seal, such as a sealing system for the shaft of a pump or any other mechanism in which water leakage from the bearing is prevented by an elastomeric lip seal that engages the shaft.

Briefly stated, these objects are attained in a sealing system for a drive shaft extending through the hull of a vessel, the outboard end of the shaft being coupled to a propeller and the inboard end being coupled to the transmission of a marine engine turning the propeller. The system includes a bearing surrounding the shaft and an elastomeric lip seal coaxial with the shaft mounted adjacent one end of the bearing to prevent water from leaking into the vessel.

The system is installed by passing the inboard end of the shaft through the bearing and the seal. Prior to such installation, a frangible protector sleeve is telescoped into the lip seal to shield its inner surface and thereby prevent damage thereto by sharp edges on the inboard end of the shaft, the sleeve having a brim which then rests against the end of the bearing. Upon completion of the installation, the sleeve is pulled by its brim out of the seal and is then ripped off the shaft.

BRIEF DESCRIPTION OF DRAWINGS

For a better understanding of the invention, reference is made to the detailed description to be read in conjunction with the drawings whose figures are as follows.

DETAILED DESCRIPTION OF INVENTION

The Sealing System

Figure 1:
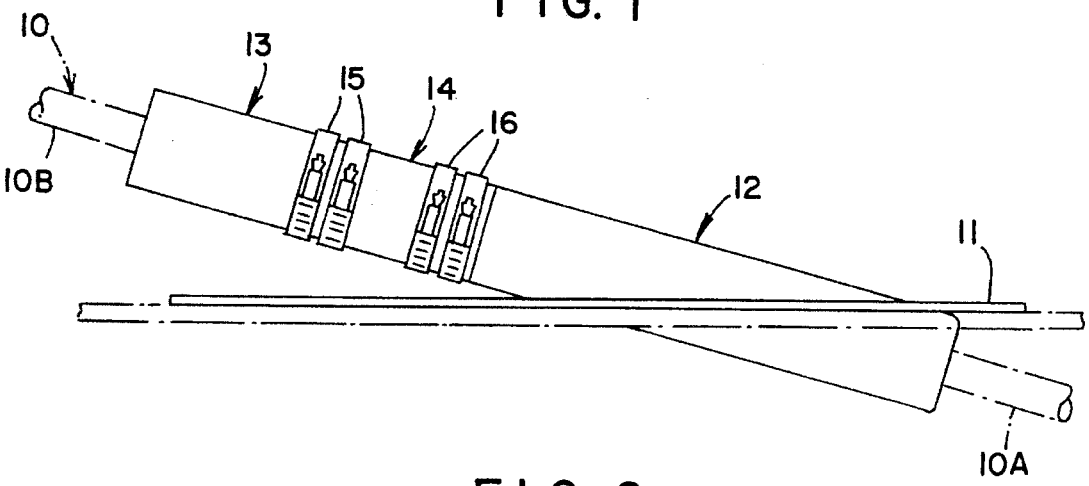
FIG. 1 is a side elevation of an assembly including a sealing system for a propeller shaft that includes a bearing provided with a lip seal.
Figure 2:
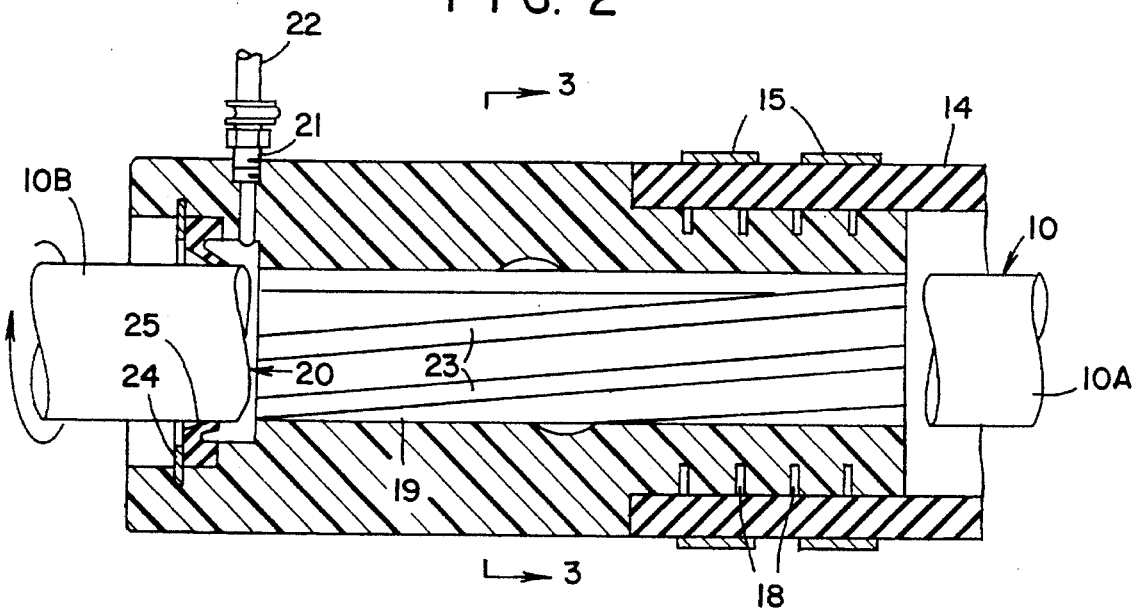
FIG. 2 is a longitudinal section taken through the bearing.
Figure 3:
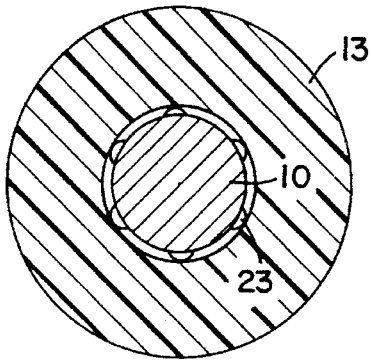
FIG. 3 is a transverse section taken in the plane indicated by line 3—3 in FIG. 2.

FIGS. 1 to 3 illustrate a sealing system of the type disclosed in our above-identified copending patent application. The system is installed on a propeller drive shaft 10 of stainless steel or other suitable marine metal which extends at an acute angle to the hull 11 of a boat or other vessel. The outboard end 10A of shaft 10 which is outside of hull 11 and is immersed in sea water is coupled to propeller (not shown), while its inboard end 10B which is within the hull is coupled to the transmission of a marine engine (not shown) serving to rotate the propeller.

Fixedly mounted on hull 11 is a hull flange shaft log assembly 12 that includes a bearing, generally represented by numeral 13, the shaft 10 extending through a longitudinal passage in the assembly. Bearing 13 is coupled to assembly 12 by a collar 14 of rubber or other resilient material. Collar 14 is clamped at one end to bearing 13 by a pair of metal straps 15, and is clamped at its other end to assembly 12 by a pair of metal straps 16.

As shown separately in FIGS. 2 and 3, bearing 13 is formed by a cylindrical body 17 of a synthetic plastic material having a very low coefficient of sliding friction. A preferred material for this purpose is an ultra-high molecular weight polymer (UHMW-polyethylene). Indented in the body 17 of the bearing adjacent its input end is an array of circumferential grooves 17 to enhance the resistance of the body 17 to rotation relative to collar 14 to which it is clamped by the pair of straps 15.

The longitudinal bore 19 in the body 17 of the bearing through which shaft 10 extends has a diameter substantially matching that of the shaft. Bore 19 is enlarged adjacent the output end of the bearing to define an annular reservoir 20 to receive sea water flowing through inclined grooves 23 cut into the cylindrical wall of the longitudinal bore 19. Thus sea water migrating upwardly through the hull flange shaft log assembly is free to pass through these grooves into reservoir 20. The water received in reservoir 20 is not trapped therein but is discharged through a fitting 21 coupled to a hose 22 that returns the water to the sea so that the sea water continuously circulates and is not in a static state.

Coaxially mounted on shaft 10 within reservoir 20 is a lip seal 23 formed of an elastomeric material such as nitrile which is held in place by an annular spring or retainer ring 24. The interior wall of the lip seal is conically tapered and terminates in a resilient lip 25 that frictionally embraces the surface of shaft 10.

Because of heat generated by friction as the shaft rotates within the lip seal, in order to avoid the resultant impairment of the lip seal, it is essential that the lip seal be cooled and lubricated at all times. Such cooling and lubrication is effected by the sea water circulating in reservoir 20 in which the lip seal is placed, the water acting to withdraw heat from the seal so that its resilient properties are retained. There is no build up of heat within the reservoir, for the water therein which collects the heat is discharged back to the sea.

Thus the sealing system illustrated in FIGS. 1 to 3 provides a low friction bearing for a propeller shaft and by means of its lip seal prevents sea water from leaking into the boat, the lip seal being cooled and lubricated to maintain it in working condition.

The Protector

When installing a sealing system of the type disclosed in FIGS. 1 to 3, the inboard end 10B of drive shaft 10 must be made to pass through bearing 13 and the lip seal 23 mounted adjacent the output end of the bearing.

As pointed out in the background section, the inboard end of a typical drive shaft is not perfectly smooth and free of discontinuities, but includes sharp edges. Hence when the shaft is forced through the lip seal whose resilient lip frictionally engages the surface of the shaft, these sharp edges may then score, abrade or otherwise mutilate the lip and seriously impair its sealing properties.

In order, therefore, to shield the lip seal when the sealing system is being installed, prior to its installation the lip seal has a protector inserted therein which serves to shield the lip and prevent it from being mutilated when the inboard end of the shaft is projected therethrough. The protector also functions to prevent the entering shaft from distorting the shape of the lip seal and in doing so to pop out the retainer spring which holds the seal in place.

Figure 4:
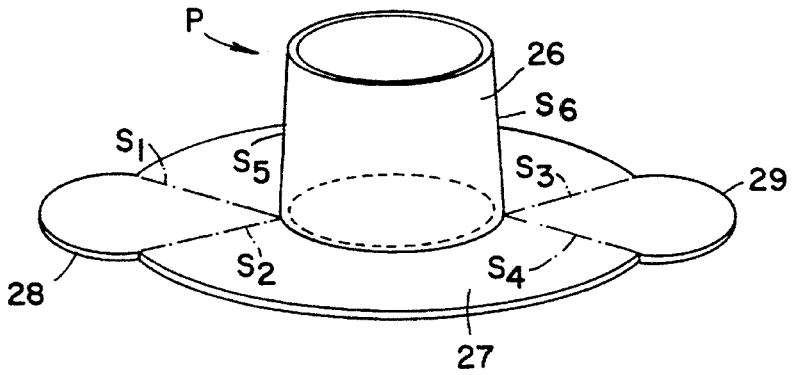
FIG. 4 is a perspective view of a first embodiment of a protector in accordance with the invention for the lip seal in the bearing.
Figure 5:
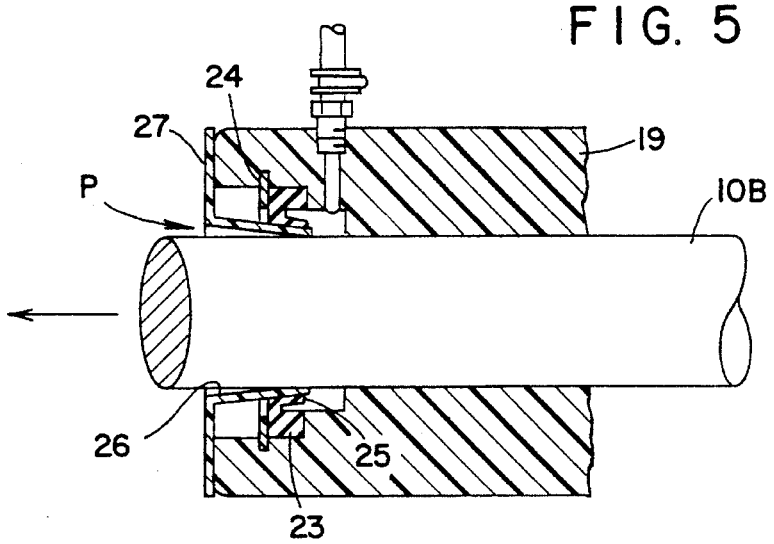
FIG. 5 schematically illustrates how the protector is inserted in the lip seal.

A preferred embodiment of protector P in accordance with the invention, as shown in FIGS. 4 and 5, is formed of a relatively stiff but frangible synthetic plastic material such as polyvinyl chloride. The protector which has a top hat shape includes a sleeve 26 having a frusto-conical form provided with an annular brim 26 having a pair of tabs 28 and 29 extending therefrom at diametrically opposed position. Score lines $S_1$ and $S_2$ forming grooves extend from opposite sides of tab 28 along the surface of brim 27 to a point adjacent the base of sleeve 26. And score lines $S_3$ and $S_4$ extend from tab 29 along the surface of brim 27 to an opposing point at the base of sleeve 26. Score lines $S_5$ and $S_6$ run along the surface of the sleeve from the points on the base to the upper end of the sleeve. These score lines which weaken the protector make it possible, as will later be explained, to tear or rip the protector off the shaft.

As shown in FIG. 5, before the sealing assembly is installed on a shaft, the sleeve 26 of protector P is telescoped into lip seal 23, so that the brim 27 then rests against the output end of the bearing body 19. The dimensions of sleeve 26 relative to that of the seal are such as to gently expand the lip seal, so that when in installing the sealing system, the inboard end 10B of shaft 10 is then projected through the lip seal, it does not act to mutilate the lip seal for the seal is now shielded by protector P. And the insertion of the shaft will not deform the lip seal and in doing so dislodge retainer ring 24.

After the sealing system is installed, the installer then pulls protector P out of the lip seal by grasping the tabs 28 and 29 which act as pull tabs, the protector being shifted to a position on shaft 10 outside of the bearing.

Then in order to detach protector P from the shaft, the tabs are flexed to break the brim along the score lines and the broken sections of the brim are used to tear the sleeve 26 in half along its score lines, thereby detaching from the shaft the protector which has served its purpose from the shaft.

When the protector which somewhat expands the lip seal is withdrawn form the lip seal, the seal then contracts and its resilient lip which encircles the shaft, then frictionally engages the shaft so that now the lip seal is operative to prevent water leakage from the bearing.

Figure 6:
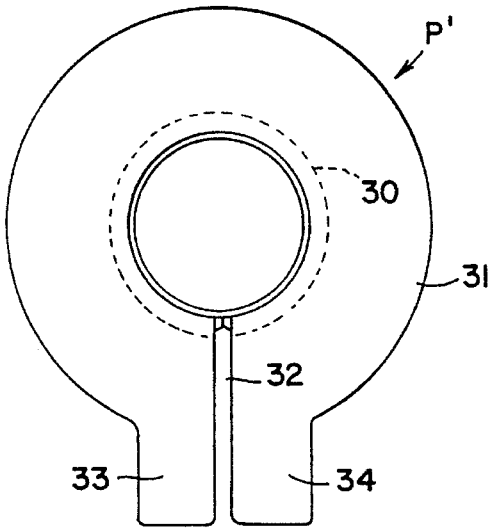
FIG. 6 is a bottom view of another embodiment of the protector.
Figure 7:
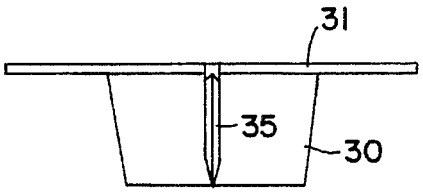
FIG. 7 is a side view of this protector.

The second embodiment of a protector $p^1$ shown in FIGS. 6 and 7 is essentially the same as the first embodiment and includes a sleeve 30 and an annular brim 31 extending outwardly -15 from the base of the sleeve. However, brim 31 is provided with a transverse gap 32 and a pair of tabs 33 and 34 which flank the gap. Sleeve 30 is provided with a tear-away trough 35 that runs from its base to its top.

Thus after protector $p^1$ has served its purpose when installing the sealing system and the protector has then been pulled out of the lip seal, it is a simple matter to detach the protector from the shaft, for all the installer has to do is to grasp tabs 33 and 34 with the thumb and index fingers of his hands, and rip off the protector.

The strength of the protector need only be sufficient for the protector to provide a shielding liner for the lip seal when the inboard end of the shaft is inserted therein. But its strength should not be such as to offer great resistance to ripping the protector from the shaft.

While there has been shown preferred embodiments of a protector in accordance with the invention for a lip seal, it is to be understood that many changes may be made therein without departing from the spirit of the invention. And the protectors are not limited in their use to a sealing system of the type illustrated, but are applicable to any sealing system having a lip seal that engages a shaft.

We claim:

1. In combination with a shaft bearing having adjacent its output end an elastomeric lip seal whose lip frictionally engages the shaft extending through the bearing to prevent water entering the bearing through its input end from leaking out of its output end, a protector adapted to shield the lip seal from mutilation when in the course of installation, the shaft is inserted in the bearing, said protector comprising:

A. a sleeve adapted to telescope into the lip seal to provide during installation of the bearing a liner to avoid mutilation of the lip seal by the inserted shaft, the inner wall of the lip seal having a frusto-conical shape and said sleeve having a corresponding shape; and B. a brim integral with the sleeve which when the sleeve is telescoped in the seal then lies adjacent the output end of the bearing, said brim facilitating withdrawal of the protector from the seal when it has served its purpose whereby the shaft is then engaged by the lip seal.

2. A combination as set forth in claim 1, in which the protector is formed of frangible material and is provided with score lines on said sleeve and on said brim to faciliate ripping the protector off the shaft.

3. A combination as set forth in claim 1, in which the dimensions of the sleeve relative to that of the inner wall of the seal is such that when the sleeve is telescoped into the sleeve, it then acts to expand the elastomeric seal to provide a circular opening for the shaft inserted therein.

4. A combination as set forth in claim 1, in which the brim is provided with diametrically opposed tab extensions to facilitate manipulation of the protector.

5. A combination as set forth in claim 4, in which the brim is provided with score lines extending from opposite sides of each of said tab extensions to a point on the base of the sleeve to facilitate ripping the protector off the shaft.

6. A combination as set forth in claim 1, in which the brim is provided with a transverse slot and a pair of tab extensions flanking the slot.

7. A combination as set forth in claim 6 in which the sleeve is provided along its length with a trough to facilitate tearing the sleeve off the shaft.

* * * * *